US007889877B2

(12) United States Patent
Lutz

(10) Patent No.: US 7,889,877 B2
(45) Date of Patent: Feb. 15, 2011

(54) DEVICE FOR GENERATING A MEDIUM STREAM

(75) Inventor: Josef Lutz, Vienna (AT)

(73) Assignee: NXP B.V., Eindhoven (NL)

( * ) Notice: Subject to any disclaimer, the term of this patent is extended or adjusted under 35 U.S.C. 154(b) by 531 days.

(21) Appl. No.: 10/562,873

(22) PCT Filed: Jun. 28, 2004

(86) PCT No.: PCT/IB2004/051029

§ 371 (c)(1),
(2), (4) Date: Dec. 29, 2005

(87) PCT Pub. No.: WO2005/001287

PCT Pub. Date: Jan. 6, 2005

(65) Prior Publication Data

US 2006/0159568 A1 Jul. 20, 2006

(30) Foreign Application Priority Data

Jun. 30, 2003 (EP) ..... 03101954

(51) Int. Cl.
*H04R 25/00* (2006.01)

(52) U.S. Cl. ..... 381/191; 381/190

(58) Field of Classification Search ..... 417/412, 417/413.1, 413.2; 310/311, 317–323, 324, 310/348; 84/730; 381/190, 191, 173, 113, 381/114, 116, 174, 176, 182
See application file for complete search history.

(56) References Cited

U.S. PATENT DOCUMENTS 3,008,013 A * 11/1961 Walker et al. ..... 381/182
3,304,446 A * 2/1967 Martinek et al. ..... 310/311
3,361,067 A * 1/1968 Webb ..... 417/322
3,606,592 A * 9/1971 Madurski et al. ..... 417/413.1
3,743,446 A * 7/1973 Mandroian ..... 417/240
3,947,644 A * 3/1976 Uchikawa ..... 310/332
4,242,541 A * 12/1980 Ando ..... 381/99
4,485,325 A * 11/1984 Yamamoto et al. ..... 310/344
4,600,076 A * 7/1986 Yamamoto et al. ..... 181/233
4,648,807 A 3/1987 Tippetts et al.
4,939,405 A * 7/1990 Okuyama et al. ..... 310/330
5,192,197 A * 3/1993 Culp ..... 417/322
5,284,179 A * 2/1994 Shikida et al. ..... 137/334
5,338,164 A * 8/1994 Sutton et al. ..... 417/413.2
5,471,540 A 11/1995 Maeda
5,725,363 A * 3/1998 Bustgens et al. ..... 417/413.1

(Continued)

FOREIGN PATENT DOCUMENTS

DE 3618106 12/1987

(Continued)

*Primary Examiner*—Huyen D Le

(57) ABSTRACT

The invention relates to a device for generating a medium stream, having a chamber, which chamber comprises chamber walls lying opposite one another and at least one medium opening for the medium stream, which medium stream can be generated in the chamber by a diaphragm, which diaphragm, in an inactive operating state of the device, is arranged substantially untensioned in the chamber between the chamber walls lying opposite one another, and associated with which diaphragm is a drive device, responsive to electrical drive signals, for driving the diaphragm to deform the same, the drive device being designed to impose a deformation on the diaphragm in an active operating state of the device, during which deformation the diaphragm has an inner mechanical tension.

30 Claims, 4 Drawing Sheets

U.S. PATENT DOCUMENTS

| | | | | |
|---|---|---|---|---|
| 6,089,534 | A * | 7/2000 | Biegelsen et al. | 251/129.01 |
| 6,201,874 | B1 * | 3/2001 | Croft et al. | 381/191 |
| 6,262,519 | B1 * | 7/2001 | Furlani et al. | 310/358 |
| 6,343,129 | B1 | 1/2002 | Pelrine et al. | |
| 6,361,284 | B2 * | 3/2002 | Drevet | 417/240 |
| 6,443,901 | B1 | 9/2002 | Fraser | |
| 6,535,612 | B1 * | 3/2003 | Croft et al. | 381/191 |
| 6,659,740 | B2 * | 12/2003 | Drevet | 417/436 |
| 6,729,856 | B2 * | 5/2004 | Cabuz et al. | 417/322 |
| 6,811,381 | B2 * | 11/2004 | Dooley | 417/53 |
| 6,856,073 | B2 * | 2/2005 | Bryant et al. | 310/324 |
| 6,948,918 | B2 * | 9/2005 | Hansen | 417/395 |
| 7,020,295 | B2 * | 3/2006 | Hamada et al. | 381/190 |
| 7,289,638 | B2 * | 10/2007 | Pavlovic et al. | 381/174 |
| 2002/0122561 | A1 | 9/2002 | Pelrine et al. | |
| 2002/0146333 | A1 * | 10/2002 | Drevet | 417/410.1 |

FOREIGN PATENT DOCUMENTS

| | | | |
|---|---|---|---|
| DE | 4041544 | A1 | 6/1992 |
| EP | 0322899 | A2 | 7/1989 |
| EP | 0322899 | B1 | 7/1989 |
| FR | 2 650 862 | A1 | 2/1991 |
| WO | 87/02718 | | 7/1987 |
| WO | 87/07218 | A1 | 12/1987 |
| WO | 2005/001287 | A1 | 1/2005 |

* cited by examiner

DEVICE FOR GENERATING A MEDIUM STREAM

This patent document is a national application of PCT Application PCT/IB04/51029, which claims priority to European Patent Application EP 031019540, filed on Jun. 30, 2003, both of which are fully incorporated herein by reference.

The invention relates to a device for generating a medium stream, which device comprises a chamber, the chamber comprising chamber walls lying opposite one another and at least one medium opening for the medium stream and being equipped with a diaphragm means, which diaphragm means is provided and constructed for generating the medium stream.

Such a device in the form of a pump is known from the patent document US 2002/0146333 A, which pump is provided for generating a pumped medium stream and with which pump a fluid medium is transported from one side of the chamber to the other side of the chamber by a diaphragm deformed analogous to a progressive wave or travelling wave. In the case of this known device, the slack, deformable diaphragm fixed at both ends has a defined thickness progression, and the fluid medium is transported from that end region of the chamber where the diaphragm is of relatively large thickness and is induced, for example, by means of e.g. a piezo element or a magnetic system, to oscillate in an undulating manner, to the opposite end of the chamber, where the thickness of the diaphragm is least. The wave induced in the diaphragm corresponds to a natural mode of the diaphragm, and is therefore not a forced oscillation having an adjustable running speed and an adjustable frequency. Such an excitation of the diaphragm is effected, as mentioned, at the admission end of the diaphragm, and, to generate the travelling wave, considerable damping as a consequence of the transported fluid is essential; the excitation frequency has to be kept low, for example in the range from 40 Hz to 80 Hz, in order to achieve an efficient transport of fluid. In the case of this known device, on the one hand, it is difficult to allow different flow rates across a relatively large variation range, and, on the other hand, it is also impossible to achieve miniaturisation. Furthermore, the known device is not suited to efficient transportation of gaseous media, since then the damping required for the natural resonance oscillation of the diaphragm is lacking.

Miniaturized conveying devices for gaseous media may in the future become increasingly important, however, especially when they allow an accurate metering or an exact setting and rapid change-over of the flow rates, as, for instance, in the case of an emission of odor substances. A need therefore exists here for the production of a device for generating a medium stream, especially in order to be able to transport and emit gaseous media in exactly metered quantities; this device shall moreover be capable of being realized in a miniaturized type of construction.

On the other hand, it is known, for example, from the patent document DE 40 41 544 A, in an electrostatic loud speaker having a plurality of stationary electrodes to guide a diaphragm is a meandering manner back and forth around the plurality of stationary electrodes in order in this way to achieve a larger active surface and hence a larger oscillating area per unit of area of the loudspeaker. Individual diaphragm portions created by the meandering arrangement of the diaphragm are here tensioned as in conventional electrostatic loudspeakers and are located in chambers that are formed by respective opposite chamber walls and have a sound outlet opening. Despite the meandering arrangement of the diaphragm, the displaceable air volume compared with a single diaphragm of the same size is scarcely increased, so that the sound pressure also remains comparatively low. Above all, the ratio of displaceable air volume to overall product volume attains only relatively low values. This known construction is moreover not capable of miniaturization, and an improvement of the ratio between the displaced air volume of the oscillating diaphragm and the overall volume would be necessary. Furthermore, a high offset voltage is needed, and without offset voltage it is not possible to operate the loudspeaker with the desired parameters.

In the case of devices for generating a medium stream acting as loudspeakers, there is therefore a need for a model in which a high useful volume (i.e. a high volume of air moved by the diaphragm) in relation to the overall volume of the device required for the construction is achieved; additionally, a modular construction with no power loss is desirable, as well as a miniaturization of the device.

It is an object of the present invention to provide a device for generating a medium stream as stated initially, in which device a medium stream can be generated with accurately definable and quickly adjustable metering, wherein any desired frequencies for the deformation of the diaphragm shall be possible; it shall also be possible to construct the device with few components and the device shall be capable of being used in a miniaturized construction, e.g. as a loudspeaker for mobile telephone hand-held devices.

The invention therefore provides, in accordance with a main aspect, a device for generating a medium stream that can be characterized in the manner specified hereinafter, namely:

A device for generating a medium stream, which device comprises a chamber, which chamber comprises chamber walls lying opposite one another and at least one medium opening for the medium stream and is equipped with a diaphragm means, which diaphragm means is provided and constructed for generating the medium stream and which diaphragm means, in an inactive operating state of the device, is arranged substantially untensioned in the chamber between the chamber walls and which diaphragm means has associated with it drive means, responsive to electrical drive signals, for driving the diaphragm means with the diaphragm means undergoing deformation, the drive means being arranged to impose a deformation on the diaphragm means in an active operating state of the device, during which deformation the diaphragm means have an inner mechanical tension.

The great advantage of the device according to the invention is that the drive means for driving the diaphragm means are preferably provided or are effective over substantially the entire (effective) length of the diaphragm means and/or of the chamber.

In an active operating state of the device according to the invention, the diaphragm means or the diaphragm is therefore not (or not necessarily) operated in a natural mode, and an excitation or the driving of the diaphragm can be effected over the entire diaphragm area, in which case a comparatively uniform behaviour is achievable. Driving of the diaphragm means is effected in such a way that a deformation of the diaphragm means is caused, the diaphragm means then having or developing an inner mechanical tension and a mechanical strength being consequently given to the diaphragm means, thus enabling the medium stream to be generated.

The device is capable of being easily integrated, i.e. is capable of miniaturization, without having to accept power losses. When constructed as a loud speaker, it is accordingly possible to realise loudspeakers from individual small modules without power loss in relation to the area; on the other hand, in the case of miniaturized loudspeakers, it is possible to achieve sound pressures such as those possible in the art only for larger loudspeakers. When the device according to the invention is used to construct pumps, extremely finely adjustable pumps can be obtained, especially for gases, and also in principle for liquids as well. Such pumps or pump devices are suitable in further consequence especially for the emission of exactly metered small amounts of odour substances or the like.

When, as is especially preferred, the device according to the present invention is used to realise a loudspeaker, then the loose or "slack" diaphragm provided in an inactive operating state of the device represents a complete departure from all previous loudspeaker systems, in which the diaphragm, even if it was optionally guided back and forth, was tensioned mechanically, both in an active and in an inactive operating state of the loud speaker system. The device according to the invention with the diaphragm means or the diaphragm and its high degree of deformation is able, however, to move a large air volume compared with the conventional loudspeakers, so that an extremely high useful volume, in relation to the overall volume of the loudspeaker, can be achieved. In the case of conventional electrodynamic or electrostatic loudspeaker systems, which without exception are based on resonance, the ratio of useful volume to overall volume is regularly below 10%—especially around 7%. With the device according to the invention, however, a useful volume (in relation to the overall volume) of 70%, 80% or even 90% (i.e. higher by a factor of 10) can be achieved. The diaphragm means can in this case position itself against the chamber walls, in which case, depending on construction, a thin insulating layer will then be provided on the chamber walls, the walls, at least in sections, being able to function as electrodes, or the insulating layer will be provided on the diaphragm means itself. In order to realise the drive system, it is also conceivable to provide a diaphragm means provided with an electrical charge, in which case the electrical charge of the diaphragm means is maintained over a period of years with no substantial losses (such foils provided with an electrical charge are per se already state of the art). Another possibility for the construction of the diaphragm means consists in providing on the diaphragm means, in sections, piezoelectric sections or coatings which are isolated from one another electrically and, when corresponding electrical voltages are applied, exert mechanical forces for the purpose of deforming the diaphragm means. A metal foil can be used for the diaphragm means, to which an electrical voltage is applied relative to electrodes provide in the region of the chamber walls, so that the diaphragm means deforms in the alternating field between the electrodes and is consequently imparted the inner mechanical tension. A foil of a dielectric material is also conceivable for realization of the diaphragm means.

The diaphragm means can be fixed in the chamber with two spaced apart end regions, wherein between these end regions the diaphragm means has a loose or slack configuration, as mentioned above, and then, in the active operating state, is deformable for the purpose of displacing a large volume of medium and develops an inner mechanical tension.

In order to assist the drive, i.e. the electromechanical drive means or excitation means, for the diaphragm means for desired deformation of the diaphragm means, an electromechanical drive element, such as especially a piezomechanical element, can act additionally on the diaphragm means at the end thereof, this drive element assisting the generation of a travelling wave of the diaphragm means by means of electrodes mounted on the diaphragm means and/or on the chamber walls.

The chamber can be in the form of a channel, that is, substantially cuboidal, openings for the displaced medium, especially gaseous medium, being provided in the region of the opposite end walls. The diaphragm means has furthermore, as is especially preferred, a substantially constant thickness over its length, by which inter alia the advantage of a comparatively simple manufacture is achieved.

As already mentioned, in the device according to the invention provision is advantageously made for the diaphragm means, by suitable control of the drive means, to undergo in operation a deformation corresponding to a progressive wave or travelling wave; it is conceivable, however, for the diaphragm means to be fixed with its end regions to the chamber walls lying opposite one another and to be arranged therebetween in such a way that, in operation or in the active operating state, a travelling transition portion extends substantially between the chamber walls lying opposite one another, more or less at right angles or slightly obliquely with respect to the chamber walls. This transition portion extending from the one chamber wall to the other is displaced continuously back and forth between the two ends and the at least one medium opening of the chamber respectively by means of the correspondingly designed drive means. The chamber forms also in this case preferably an on the whole cuboidal channel of rectangular cross-section. Because of the displacement back and forth of volumes, this construction is not, however, suitable as a pump, but is very suitable as a sound generator (loudspeaker), wherein a comparatively large volume of air is displaced back and forth. Since the sound pressure is approximately proportional to the displaced volume of air, a substantially smaller loudspeaker with no power loss can be assembled, in particular from individual small modules. It must be remembered here that in the case of current miniaturized loudspeakers, in which only very small air volumes can be displaced, a minimum sound level is produced, so that these small loudspeakers are used only at or in the ear. By way of comparison, in the case of the device according to the present invention, as mentioned, air volumes 10 times as large are displaced, i.e. the ratio of displaced air volume to overall volume of the component is substantially increased, so that applications of comparably small loudspeakers away from the ear are possible and, at predetermined sound levels, substantially smaller overall sizes.

A somewhat better ratio of displaced air volume to overall volume can be achieved in the case of the above-described travelling wave construction option, in which the diaphragm means, as mentioned, is deformed analogous to a travelling wave—the frequency of which can lie in the ultrasound range. With this travelling wave diaphragm, at least one full wave train of the displaced diaphragm means is provided; preferably, however, the diaphragm means can be deformed by a longer wave train, for instance corresponding to 1½ or 2 wavelengths. Here too, the diaphragm means can be caused by different drive sources to execute undulatory displacements of pre-determinable frequency, the displacements of the diaphragm means producing a travelling wave. The travelling wave of the diaphragm means generates an air stream varying in time in one direction, similar to a "air pump", wherein optionally a smoothing can be incorporated; the intensity or amplitude of the air stream can be varied by the speed of the travelling wave, that is, by the frequency of the pulses where the travelling wave is induced by pulses. In the borderline case with a single wave train, one cannot, strictly speaking, talk of a travelling wave any more, the deformation of the diaphragm means is reduced substantially to an oscillation with a high proportion of a second harmonic and a fixed phase relation to one another.

These and other aspects of the invention are apparent from and will be elucidated, by way of non-limitative example, with reference to the embodiments described hereinafter.

Figure 1:
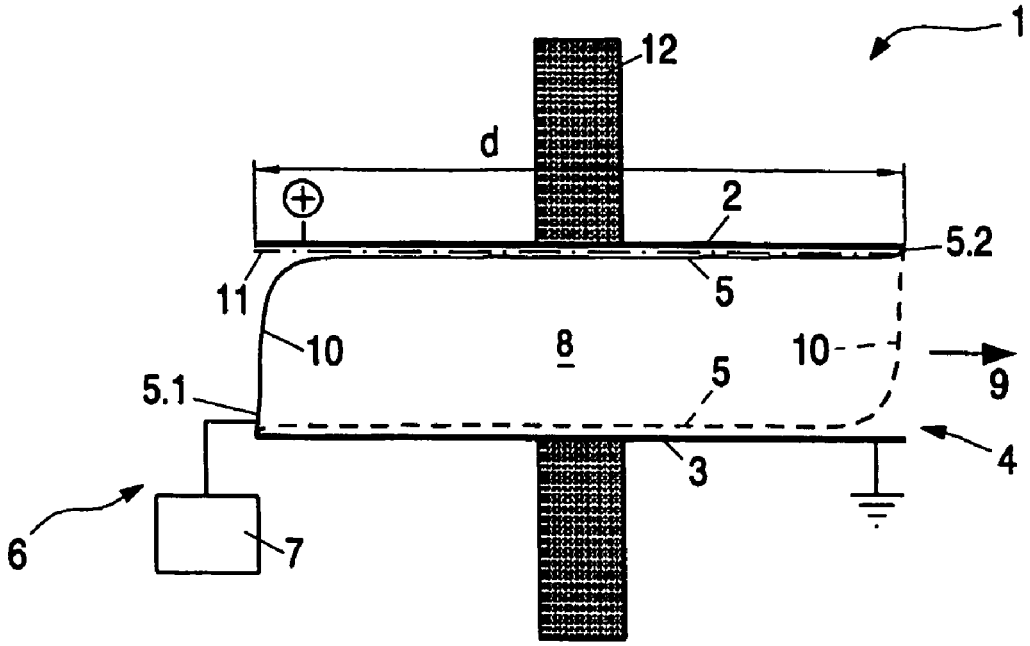
FIG. 1 shows schematically a longitudinal section through a device for generating a medium stream in the form of a loudspeaker, two end positions of the diaphragm means relative to two chamber walls lying opposite one another being illustrated.

FIG. 1 shows schematically the construction principle of a device 1 for generating a medium stream, wherein a diaphragm means 5 is arranged between two oppositely located chamber walls 2, 3, which, together with two lateral walls, not more specifically shown, that connect the chamber walls 2, 3 laterally (i.e. parallel to the plane of the drawing), define a cuboidal chamber formed by a channel 4 for the medium stream. This diaphragm means 5, hereinafter called diaphragm 5 for short, is fixed with a rear end region 5.1 to the chamber wall 3 at the bottom according to the illustration in FIG. 1, and with the opposite other front end region 5.2 is fixed to the other, upper chamber wall 2, so that in relation to the cuboidal channel 4 the two fixing regions lie diametrically opposite one another. The diaphragm 5 is furthermore electrically isolated with respect to the chamber walls 2, 3, and generally electromechanical drive means 6 for energizing the diaphragm 5 are provided. Unlike conventional loudspeakers, like for instance dynamic loudspeakers or electrostatic loudspeakers, in the case of the present device 1 the diaphragm 5 is not tensioned, despite the secured end regions 5.1 and 5.2, but in an inactive operating state of the device 1 is arranged loose or slack in the chamber formed by the channel 4.

According to FIG. 1, the drive means 6 comprise a control signal source 7, from which control signal source 7 in an active state of the device 1 an electrical control signal (or several control signals) corresponding to the particular sound to be generated is (are) applied to the diaphragm 5 and/or to electrodes formed by the chamber walls 2, 3. The diaphragm 5 comprises, for example, a thin metal foil, having a thickness in the micrometer range to nanometer range. A dielectric foil or a foil of doped silicon material or the like would also be possible. The opposite chamber walls 2, 3 are, as shown in FIG. 1, specifically at different electrical potentials, which is indicated in FIG. 1 by the symbols "+" and a grounding symbol respectively, and the signal voltage is supplied to the diaphragm 5. Depending on the voltage applied to the diaphragm 5, as supplied by the control signal source 7, the diaphragm 5 is drawn towards a chamber wall 2 or 3 and repelled from the respective other chamber wall 3 or 2, with the result that the diaphragm 5 is deformed in accordance with the natural laws of electrostatics. With a deformation of the diaphragm 5 for instance as seen in FIG. 1, namely from the position shown by solid lines into the position shown by broken lines, an air volume 8 is displaced and moved in the direction of the arrow 9. Upon a deformation subsequent thereto back into the position shown by solid lines, the direction of the displacement of the air volume in this embodiment of the device 1 is reversed again. Such a deformation of the diaphragm 5, and hence generation of a medium stream (gas volume) moved back and forth, is effected independently of the natural resonance of the diaphragm 5, but in accordance with the signal applied by the control signal source 7. That part of the diaphragm 5 that at any one time extends between the two oppositely located chamber walls 2, 3 can be called the transition portion 10, and this transition portion 10 is displaced corresponding to the imposed diaphragm deformation from the rear to the front in the direction of arrow 9 and then back in the opposite direction to the arrow, cf. also the intermediate position of the transition portion 10 in the illustration shown in FIG. 2. The respective air volume on one side of the diaphragm 5 is expelled from the channel 4 (at one end thereof) by this displacement of the transition portion 10 of the diaphragm 5, but is sucked in on the other side. In this way, as mentioned above, an air volume is displaced in the direction of the arrow 9 or in the opposite direction, and with correspondingly rapid displacement processes, with corresponding alternating electrical voltages issued from the control signal source 7 to the electrodes, corresponding sound waves are emitted. The maximum displaceable air volume is defined by the two extreme positions of the diaphragm 5 evident from FIG. 1, that is, in particular between the two extreme positions of the transition portion 10. Unlike the case of a dynamic loudspeaker, however, in the case of the device 1 shown it is possible for the maximum displaceable air volume, and hence the sound pressure of the generated sound wave per unit of area of the loudspeaker, to depend only on the length d of the air channel, i.e. the channel 4, and not on the two other dimensions of the loudspeaker, i.e. the dimension in the direction transversely to the plane of the drawing in FIG. 1 and the distance between the two chamber walls 2, 3 respectively. In this way, it is possible to realize a modular construction principle for the loudspeaker, in which, depending on the desired sound level, several modules corresponding to FIG. 1 can be arranged side by side, that is, parallel to the plane of the drawing, and above one another and below one another respectively, and be controlled in parallel. Such an arrangement of several modules then produces a mosaic-like area in relation to the sound outlet openings, in which case the mosaic-like area can comprise almost any geometrical areas, for example, circular, triangular, rectangular areas or irregular areas. The modules can additionally be arranged offset with respect to one another, whereby the resulting arrangement can be of layered construction. Such arrangements are advantageous when, in case of use as a loudspeaker in an appliance, only limited areas or volumes are available, such as, for example, in the case of mobile telephones or the like.

Since the diaphragm 5 positions itself against the chamber walls 2, 3 in operation, an electrical insulation is required between these components, which can be achieved, for example, by an insulating coating of the chamber walls 2, 3, but in FIG. 1 for the sake of simplicity this is shown only schematically at the upper chamber wall 2 with an insulation 11. A corresponding insulation can alternatively, however, be provided on the diaphragm 5 itself.

In order to counteract any physical forces (for example, van de Waals forces) occurring between the diaphragm 5 and the insulation 11, the diaphragm 5 and/or the insulation 11 can have a rough or structured surface.

Furthermore, mounting means 12 are indicated in FIG. 1, which mounting means 12 carry the oppositely located chamber walls 2, 3 (as well as the lateral walls not shown), and are primarily intended to effect an acoustic separation of "front side" and "rear side" of the loudspeaker.

Figure 2:
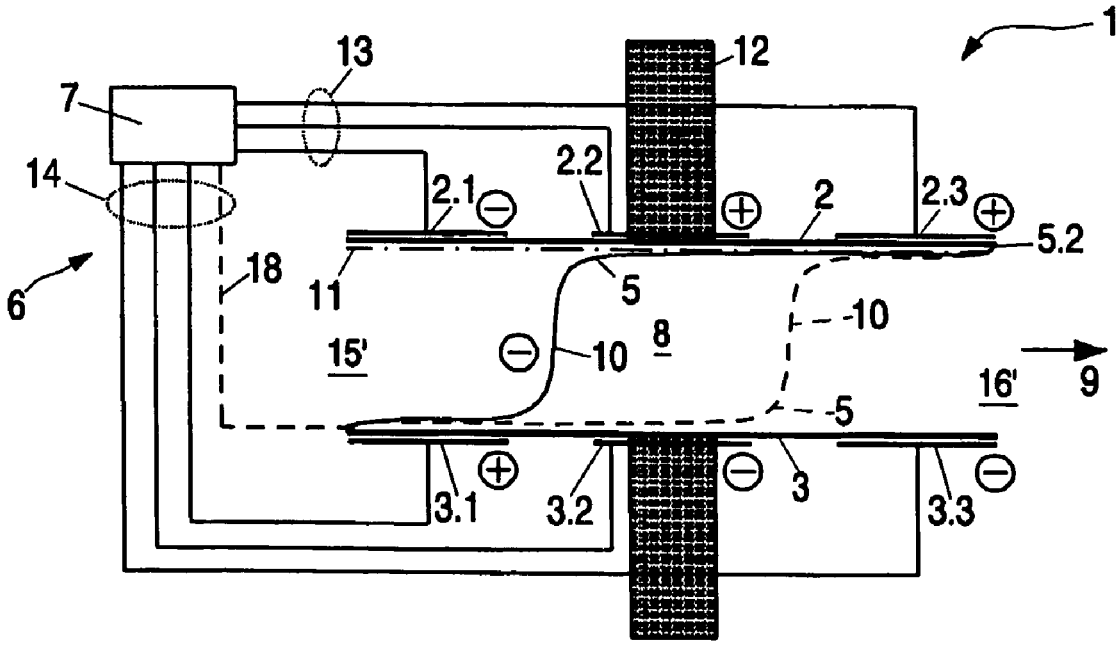
FIG. 2 shows in a comparable longitudinal section a similar loudspeaker device, but with drive means that have been modified with respect to FIG. 1, an intermediate position of the diaphragm means in operation additionally being shown.

FIG. 2 shows in a comparable schematic view a quite similar device 1 for generating sound by means of a slack diaphragm 5, the diaphragm 5 again being retained at the rear end of the lower chamber wall 3 and at the front end of the upper chamber wall 2 lying opposite the chamber wall 3, so that a transition portion 10 that moves in operation is formed between the two chamber walls 2, 3. In the illustration of FIG. 2, this transition portion 10 of the diaphragm 5 is already located in an intermediate position compared with the two end positions apparent from FIG. 1, and it is indicated in FIG. 2 by broken lines in a further intermediate position.

Unlike the case in FIG. 1, in this case the drive means 6 are realised by mounting electrodes 2.1, 2.2, 2.3 . . . and 3.1, 3.2, 3.3 . . . respectively (by way of non-limitative example only three electrodes are shown in each case) on the two chamber walls 2, 3, the two chamber walls 2, 3 moreover being in the form of insulators. The diaphragm 5 comprises, for example, again a thin conductive material, namely a thin metal foil. It should be mentioned that the diaphragm 5 can be formed from a thin doped silicon foil, optionally also from a thin dielectric material with an electrical charge applied thereto. Such a foil material with charge can be constructed, for example, from conventional polycarbonate foils per se, which are laid one on top of the other and are subjected to a drawing process. This produces a composite foil with cavities, and these cavities can be ionised by means of electron bombardment. The resulting electrical charge can be maintained at room temperature conditions for years. Such charged foils are already known per se and can also be used for the present purpose.

The electrodes 2.1, 2.2, 2.3 . . . and 3.1, 3.2, 3.3 . . . respectively (more than the three electrodes shown in each case can also of course be mounted on the chamber walls 2, 3) receive from a control signal source 7 via corresponding control lines 13 and 14 respectively a supply of signals, in order thus to draw the diaphragm 5 cyclically in portions towards the one chamber wall 2 and 3 respectively and to repel it from the other chamber wall 3 and 2 respectively. FIG. 2 illustrates, for example, the situation in which the diaphragm 5 (here having a negative potential) is drawn towards the first lower electrode 3.1 on the lower chamber wall 3. The further upper electrodes 2.2 and 2.3 are at this point in time still positively charged, so that the negative diaphragm 5 is attracted by them. In the next phase, the potential of the middle electrodes 2.2 (from + to −) and 3.2 (from − to +) respectively is then changed, so that the transition portion 10 moves further into the position shown by a broken line, in which the diaphragm 5 is then attracted in the middle region by the lower electrode 3.2. A similar control is effected in all other phases, so that upon corresponding control signals the diaphragm 5 is deformed cyclically in the described manner, with the transition portion 10 being displaced back and forth and hence with volumes of air being cyclically expelled and sucked in at each side of the device 1. In this way, with corresponding frequencies of the deformation of the diaphragm 5, in turn the desired sound can be generated. If the diaphragm 5 is constructed as a charged insulator (i.e. the diaphragm 5 has no potential connection), electrical repulsive forces can be exploited; in this case, the electrical signals applied from the signal source 7 can also have a relatively low voltage amplitude.

The devices 1 described above with reference to FIGS. 1 and 2 can be assembled from just a few components, wherein all components can be manufactured from integrable solid-state elements. The construction can be modular, and the base element can be reduced in size virtually as desired. Depending on the power requirement, the individual modules are connected in parallel, the sound energy flux generated overall being proportional to the number of modules. Since, furthermore, the system is not operated at its natural frequency, the intrinsic properties of the sound source remain virtually influenced by the acoustic surroundings. Compared with conventional loudspeaker systems, especially dynamic loudspeakers, the overall length d of the air channel (see FIG. 1) can be used for displacement of the air, and a substantially higher sound pressure can be generated. In particular, the ratio already mentioned above of useful volume (i.e. volume of the displaced air) to the total volume (overall volume) is greater by a factor of ten (10) than in the prior art. The sound energy flux generated is constant as a function of the frequency across the entire frequency range, and, furthermore, direct digital control signals are possible, as is apparent for example from the preceding explanation of the mode of operation of the device 1 according to FIG. 2. An important advantage is the module principle, already mentioned several times, i.e. it is possible without power loss per unit of area to construct loudspeakers from individual modules. The linearity of the generated sound over the amplitude depends ultimately virtually only on the linearity of the flow rate as a function of the control signal; if desired, an electronic compensation can easily be provided here.

The ends 15', 16' of the chambers of the device 1 shown in FIG. 1 or 2 are preferably open, i.e. they form openings for the displaced air or sucked-in air.

Figure 3:
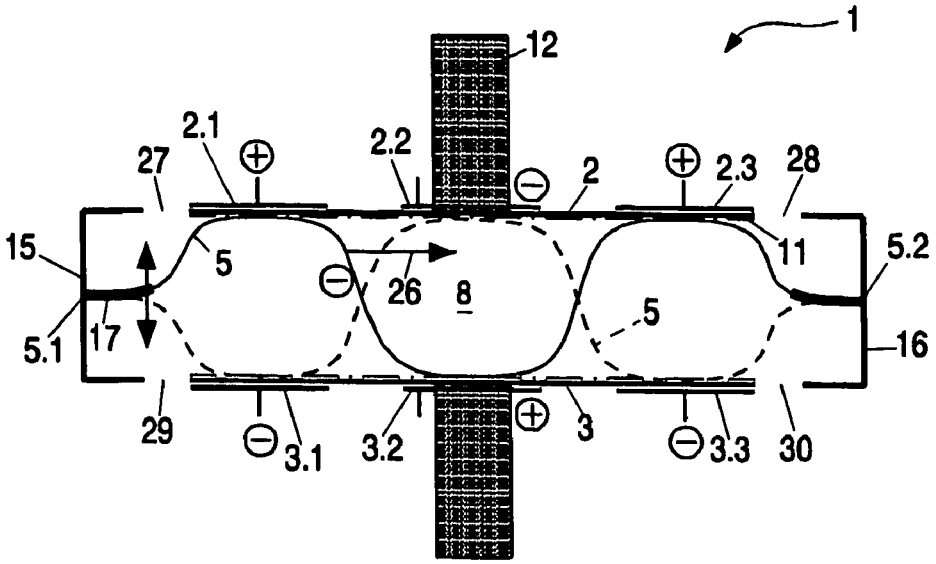
FIG. 3 shows another embodiment of the present invention for generating a medium stream, which is based on the principle of a forced travelling wave and can be used both as a loudspeaker and as a pump.

FIG. 3 illustrates a device 1 for generating a medium stream that has been modified compared with FIGS. 1 and 2, having a diaphragm 5 that is loose or slack in the inactive operating state of the device 1; in this case, in the active operating state of the device 1, a travelling wave is imposed on the diaphragm 5 by corresponding electrical excitation by means of drive means 6 still to be explained and only part of which is indicated. The device 1 according to FIG. 3 again contains a chamber having an upper chamber wall 2 and a lower chamber wall 3 lying opposite this upper chamber wall 2 (upper and lower again referring to the illustration in the drawing).

The diaphragm 5, which in plan view is essentially rectangular, is arranged between these chamber walls 2, 3, the diaphragm 5 being fixed with its end regions 5.1 and 5.2 to a rear end wall 15 and a front end wall 16 respectively, in each case approximately in the geometrical middle between the two chamber walls 2, 3. The rear end region 5.1 of the diaphragm 5 is here equipped with a drive element 17, preferably in the form of a piezo element, via which drive element 17, similar to an excitation by a swinging rod, the diaphragm 5 is caused to oscillate starting from the rear end. This preferred excitation of oscillation at the end is combined with excitation of a travelling wave in the diaphragm 5 by alternating electrical potentials, which are applied to electrodes 2.1, 2.2, 2.3 . . . and 3.1, 3.2, 3.3 . . . respectively on the chambers walls 2, 3—which incidentally again have an insulating function—from a signal source (rather like the illustration in FIGS. 2 to 7; this control has been omitted in FIG. 3 for the sake of simplicity). The diaphragm 5 itself again has, for example, a negative potential, which is likewise applied by a control line, for example, the control line 18 shown by a broken line in FIG. 2. As an alternative to this, the diaphragm 5 can again be provided from the outset with a—negative—electrical charge, so that applying an electrical potential is unnecessary. It is likely, however, that the piezoelectric element drive element 17 according to FIG. 3 will have to be connected to a corresponding control output of the signal source 7 in order to effect excitation of oscillation with the desired frequency—matched to the frequency of the signals to the electrodes 2.1 to 3.3.

Also in the embodiment according to FIG. 3, the diaphragm 5 can comprise a thin metal foil in the micrometer or nanometer rang, and it has a constant thickness. The metal used for the diaphragm 5 can be, for example, as in the case of FIGS. 1 and 2, aluminum.

By the controlled, pulse-form application of the alternating electrical potentials to the electrodes 2.1 etc., portions of the diaphragm are again, in a manner similar to that in the embodiment according to FIG. 2, respectively attracted and repelled by electrodes, so that a waveform is generated; now, however, the activation is such that the wave-form deformation of the diaphragm 5 is a travelling wave or running wave, a different extreme position of the diaphragm 5 in FIG. 3 being represented by a broken line.

Figure 4:
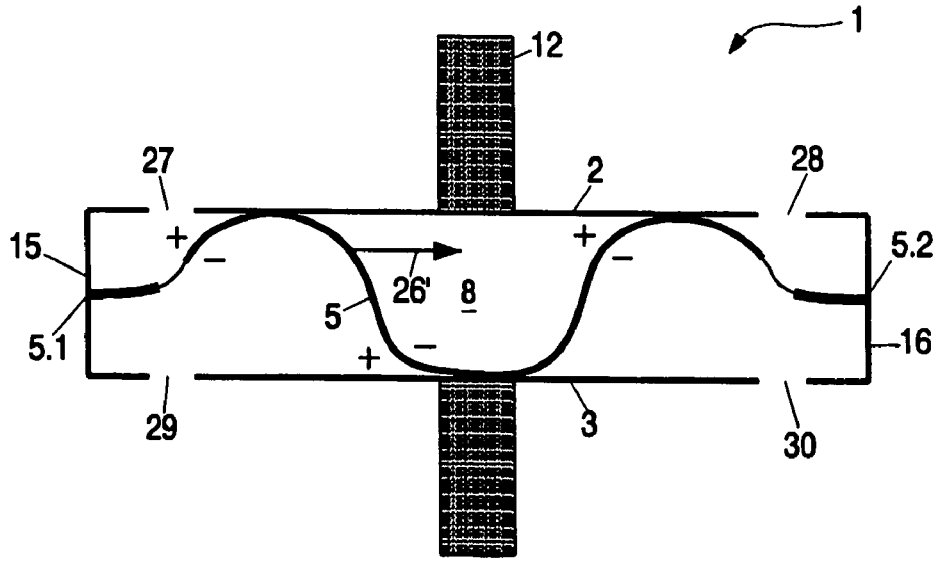
FIG. 4 shows in a comparable schematic longitudinal sectional view a similar device with travelling wave diaphragm means, but with modified drive means.
Figure 5:
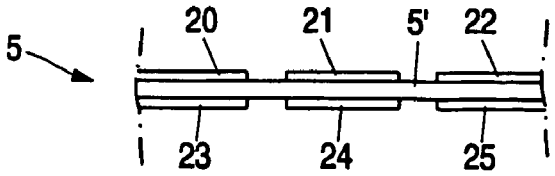
FIG. 5 shows in a schematic and fragmentary view a diaphragm means with piezo material layers.

In the embodiment according to FIG. 3, comparatively high electrical fields are necessary in order to generate the travelling wave at the diaphragm 5. In order to satisfy requirements with lower electrical voltages, the diaphragm 5 can also be manufactured with piezo element portions, as illustrated in FIG. 4, i.e. the diaphragm 5 has a structured surface with piezoelectric layers separated from one another, cf. also FIG. 5, which shows a portion of such a diaphragm 5 having "piezo elements" 20, 21, 22 and 23, 24, 25 respectively disposed on a plastics carrier film 5'. These piezoelectric areas or piezo elements 20 to 25 are again connected by way of contacts and control lines, not more specifically shown, similar to the control lines 13 and 14 in FIG. 2, to a signal source, similar to the signal source 7 in FIG. 2, in order to excite a travelling wave in the diaphragm 5 by applying alternating potentials with suitable phase shift. This principle is indicated in FIG. 4 with polarity signs for the particular electrical bias voltages of the "piezo elements" (which are not more specifically shown); it should be added that the alternating potentials cause a positive and negative curvature respectively of the piezo layers, and hence a corresponding deformation of the diaphragm 5. In this case of the embodiment according to FIG. 4, the chamber itself with its chamber walls 2, 3, with the end walls 15, 16 and with the lateral walls, which are again present but not shown, can comprise an insulating material.

It should be mentioned that in the case of the embodiments according to FIGS. 3 and 4, retaining or mounting means 12 for the chamber of the device 1 in question are present. These retaining means 12 are again indicated only rather schematically in FIGS. 3 and 4 and moreover serve for an acoustic decoupling between front side and rear side.

In addition, the running direction of the travelling wave in the diaphragm 5 is indicated in FIGS. 3 and 4 with arrows 26 and 26' respectively.

With a device such as that shown in FIG. 3 or 4, an even more intensive air displacement compared with that according to FIGS. 1 and 2 can be achieved, i.e. the ratio of useful volume (displaced air volume) to the volume of the component is even greater (for example 80% or 90% instead of 70%), compared with the embodiment according to FIGS. 1 and 2. In other words, with a device according to FIG. 3 or 4 even more medium can be "pumped through" by means of the diaphragm 5 on which the travelling wave is imposed, wherein, for example, in the case of a sound generator, a travelling wave in the ultrasound range is generated, whereas a sound signal in the audible frequency range is defined by the varying overall air volume occurring on average.

From FIGS. 3 and 4 it is furthermore apparent that in the opposite chamber walls 2, 3 close to the end walls 15, 16 there are openings 27, 28 and 29, 30 respectively for the admission of medium and exit of medium respectively, in order thus to be able to draw in and expel medium (air) when the diaphragm 5 is deformed corresponding to the electromechanical excitation. The effect of these openings 27, 28 and 29, 30 respectively is that on the other side thereof, that is, between them and the respective adjacent end wall 15 and 16, cavities are left, which, as damping "cavities", effect a smoothing of the pulsating airflow generated on deformation of the diaphragm 5 in the manner of a travelling wave, so that outside the device 1 a virtually constant airflow for the short time units under consideration occurs. The amplitude of this airflow can be varied by the speed of the running wave, i.e. travelling wave, and thus by the frequency of the pulses in the case of pulsed excitation of the travelling wave, as is clear from FIG. 10. At high excitation frequencies or with rapidly travelling waves, the amplitudes of the airflow can consequently be varied in accordance with an emission of a sound wave. Depending on the nature of the excitation of the diaphragm 5, it is possible for the travelling wave to be excited alternately in the one and in the other direction, with the result that a mode of operation similar to that of FIGS. 1 and 2 is achieved; with this mode of operation, a constant portion of the flow of air is advantageously avoided, so that only a varying amplitude portion of the flow of air is provided for the sound generation.

Figure 6:
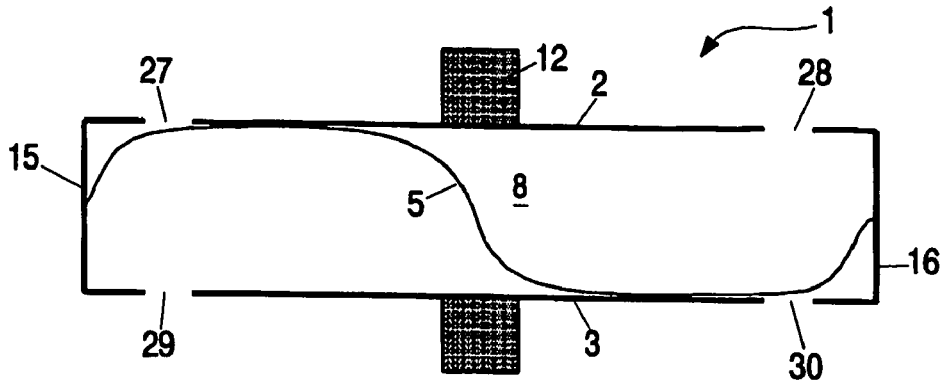
FIGS. 6 to 9 show a further device of the kind shown in FIGS. 3 and 4, but with a diaphragm means in which only a single wave train is formed, the diaphragm means being shown at different points in time, i.e. in different states of deformation.
Figure 7:
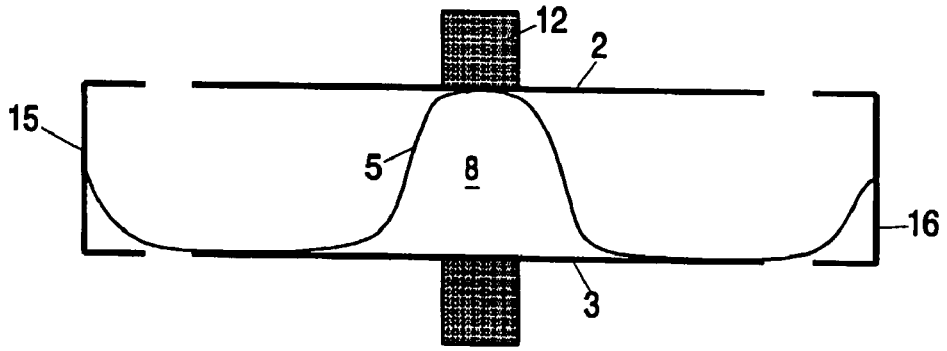
Figure 8:
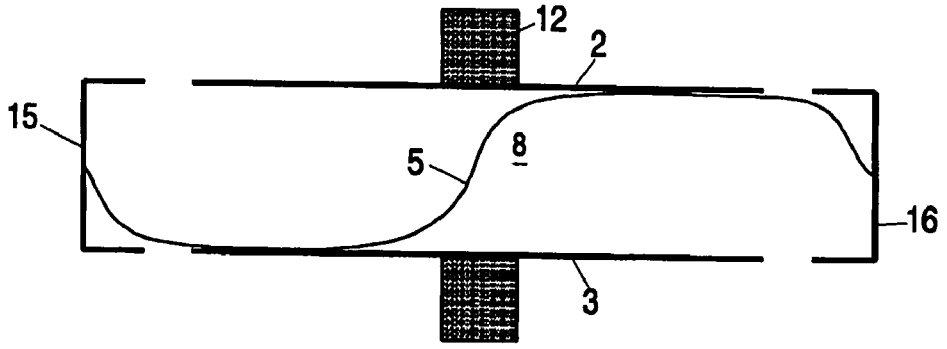
Figure 9:
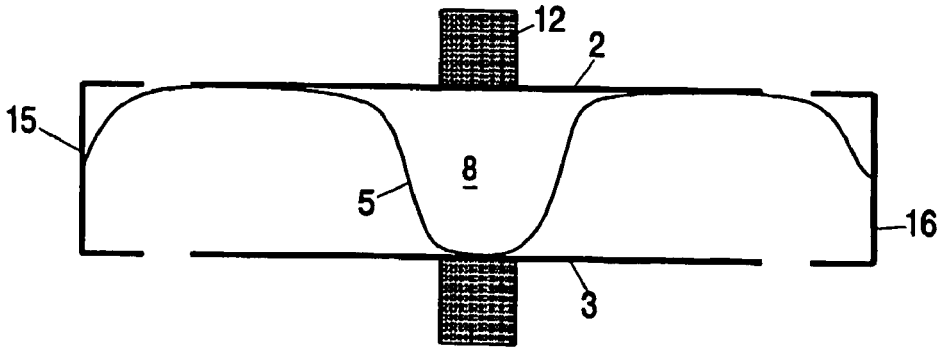

In FIG. 6 and in the associated FIGS. 7, 8 and 9, in which different operational phases are shown, a borderline case for a device 1 according to FIG. 3 or 4 is shown, namely, the case in which a single wave train is formed with the diaphragm 5. In that case, by the applied alternating potentials (either at electrodes as shown in FIG. 3 or at "piezo elements" on the diaphragm 5 itself, as illustrated in FIG. 4) the diaphragm 5 is cyclically deformed, for example, starting from an approximately sinusoidal wave configuration, see FIG. 6, wherein, as shown in FIG. 7, in a first phase the rear portion, on the left in FIG. 7, of the diaphragm 5 is drawn downwards, whilst the middle portion of the diaphragm 5 is drawn upwards; following that, the front portion, on the right in the drawing, of the diaphragm 5, is drawn upwards, see FIG. 8, so that a position of the diaphragm 5 opposite in phase compared with FIG. 6 is obtained. Subsequently the left or rather rear portion of the diaphragm 5 is again drawn upwards, whereas the middle portion is drawn downwards, cf. FIG. 9, this configuration of the wave 5 according to FIG. 9 being opposite in phase to that according to FIG. 7. Next, the state shown in FIG. 6 is reached again. This movement of the diaphragm 5 is thus reduced compared with a longer wave train, for instance according to FIG. 3 or 4, essentially to an oscillation with a high proportion of a second harmonic with a fixed phase relation.

With the devices according to FIGS. 3 to 9, likewise only a small number of components is necessary, and it is likewise of advantage that here too all components can be manufactured from integrable solid-state elements. Miniaturisation more or less as desired is likewise possible, likewise a modular construction, the sound flux being as a whole proportional to the number of the individual modules.

Furthermore, where a medium stream is generated always in one direction, for instance from left to right, in accordance with the arrows 26 and 26' respectively in FIGS. 3 and 4, it is possible to achieve a uniform flow, so that in the case of a loudspeaker the lower limiting frequency is 0 Hz. On the other hand, this mode of operation can be used to achieve a medium pump that can be adjusted and metered extraordinarily quickly and exactly, and is suitable especially for the transport of air or gas in general, but in principle also for the transport of liquid media. Here too, digital activation signals are again possible, and the linearity over the amplitude (few harmonic waves) depends virtually only on the linearity of the flow rate as a function of the control signal, wherein optionally, if desired, an electronic compensation can be provided. As far as the principle goes, the generated sound flux of the sound source as a function of the frequency is likewise constant over the entire frequency range, and it is possible to construct a loudspeaker from individual modules without power loss per unit of area.

The piezoelectric diaphragm, for instance according to FIG. 4, can also be provided by producing a customary PZT material of a very small thickness (up to 1 μm), which is either applied to a carrier foil, or alternatively can be used directly as diaphragm, with individual portions of the diaphragm being insulated.

Figure 10:
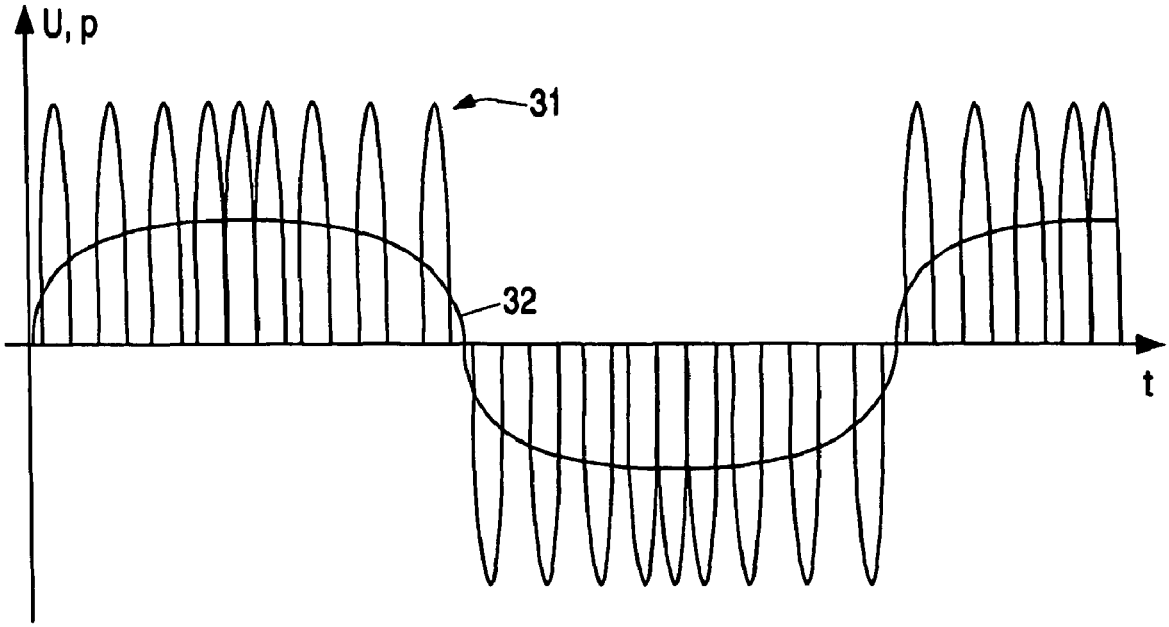
FIG. 10 shows a diagram of the signal pulses to be applied to the diaphragm drive means and the resulting sound signal when the device according to FIG. 3 or 4 is constructed for instance as a loudspeaker.

FIG. 10 illustrates in a schematic diagram how a deformation and hence a travelling wave can be generated in a diaphragm, such as the diaphragm 5 according to FIGS. 1 to 9, by means of comparatively short pulses 31 varying in pulse rate. The diaphragm is deformed with these pulses 31, so that, for example, an air volume is displaced alternately back and forth, so that a sound signal 32 having a lower frequency than the pulse rate is produced. Compared to this sound signal 32 in the audible frequency range, the pulses 31 have an ultrasound frequency.

Figure 11:
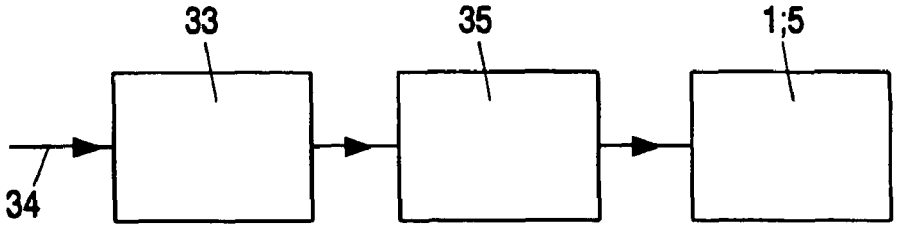
FIG. 11 shows a block diagram for the control of such a device (according to FIG. 10).

In order to generate such pulses 31, or rather in general a control signal, according to FIG. 11 a voltage-to-frequency converter 33 is used, to the input 34 of which an electrical signal coming from an amplifier or similar useful signal circuit, not shown, is supplied, which reflects the desired sound signal (or optionally a control signal for metering medium volumes to be transported). Connected to the voltage-to-frequency converter 33 is an electrode control unit 35 with a pulse shaper and a shift register, which then activates or excites the diaphragm 5 or generally the device 1.

It should be mentioned that as far as the deformations of the diaphragm 5, especially the curvatures thereof, are concerned, the illustrations in the drawings are only schematic and somewhat exaggerated; in practice, the diaphragms 5 will experience smaller curvatures and deflections, i.e. the ratio of height to length will be smaller.

The invention claimed is:

1. An audio speaker device for generating an audio medium stream representing audio data, the device comprising:

a chamber that comprises chamber walls lying opposite one another and at least one medium opening for the audio medium stream, a diaphragm to generate the audio medium stream, the diaphragm being arranged substantially untensioned in the chamber between the chamber walls in an inactive operating state of the device, an audio driver circuit, responsive to electrical drive signals corresponding to the audio data, for driving the diaphragm to impose a deformation on the diaphragm via mechanical tension to generate audible sound corresponding to the audio data in an active operating state of the device.

2. A device as claimed in claim 1, wherein the driver circuit includes electrodes arranged on the chamber walls lying opposite one another, further including a control signal source configured to apply a voltage to the electrodes in a manner that deforms the diaphragm to generate sound.

3. A device as claimed in claim 2, wherein the diaphragm comprises a metal foil.

4. A device as claimed in claim 2, wherein the diaphragm comprises a foil made of a dielectric material.

5. A device as claimed in claim 2, wherein at least one of the diaphragm and the chamber walls have a structured surface.

6. A device as claimed in claim 1, wherein the diaphragm consists at least partly of piezoelectric material.

7. A device as claimed in claim 6, wherein the diaphragm comprises an electrode.

8. A device as claimed in claim 1, wherein the diaphragm comprises two end regions provided a distance apart from one another, which end regions are fixed in the chamber.

9. A device as claimed in claim 1, wherein the driver circuit includes an electromechanical drive element, and the diaphragm has an end portion that is connected to the electromechanical drive element.

10. A device as claimed in claim 1, wherein the chamber is of substantially cuboidal construction and comprises two end walls lying opposite one another.

11. A device as claimed in claim 10, wherein the diaphragm is fixed with two opposing end regions to the end walls of the essentially cuboidal chamber.

12. A device as claimed in claim 11, wherein the driver circuit is configured to impose a cyclic deformation in the form of a traveling wave on the diaphragm, to generate a sound wave corresponding to the traveling wave.

13. A device as claimed in claim 10, wherein the diaphragm is fixed with one end region close to one end of the cuboidal chamber to the one chamber wall of the mutually opposed chamber walls and with an opposite end region close to the opposite end of the chamber to the other chamber wall of the mutually opposed chamber walls.

14. A device as claimed in claim 13, wherein the diaphragm comprises a transition portion extending in operation substantially at right angles to the chamber walls lying opposite one another.

15. A device as claimed in claim 13, wherein medium openings are provided at both ends of the chamber.

16. A device as claimed in claim 1, wherein the chamber comprises at least two medium openings provided spaced apart from one another.

17. A device as claimed in claim 1, wherein the diaphragm has an at least substantially constant thickness.

18. A device as claimed in claim 1, wherein the driver circuit is configured to impose a deformation having at least a pre-determinable frequency.

19. A device as claimed in claim 1, in which device the medium stream is a stream of a gaseous medium.

20. A device as claimed in claim 1, which is provided for the generation of sound by means of the medium stream generated, in response to electrical sound-driver signals applied to the drive by a controller.

21. A device as claimed in claim 1, wherein the device is configured to operate as pump device for the medium stream.

22. A device as claimed in claim 1, wherein a number of chambers are provided in the device, which chambers are arranged in one unit.

23. A device as claimed in claim 1, wherein at least one of the diaphragm and the chamber walls have an insulating layer.

24. The device of claim 1, wherein the diaphragm is configured in a slacked amorphous configuration in its untensioned inactive state.

25. The device of claim 1, wherein the diaphragm is substantially devoid of peaks and valleys in its untensioned inactive state.

26. A device for generating a medium stream including sound waves, the device comprising:

a chamber having chamber walls lying opposite one another and at least one medium opening therebetween for passing a medium stream;

a diaphragm and extending laterally between the opposing chamber walls, the diaphragm to generate audio, corresponding to the sound waves from the medium stream, being substantially untensioned in the chamber between the chamber walls in an inactive state;

electrodes on each of the opposing chamber walls and responsive to electrical drive signals by imposing a deformation on the diaphragm in an active operating state of the device, during which deformation the diaphragm has an inner mechanical tension, the deformation causing fluid flow in the chamber in a direction that is about parallel to the chamber walls to generate sound corresponding to the sound waves from the medium stream, that is audible by a human ear.

27. The device of claim 26, wherein the electrodes are separate from and not in contact with the diaphragm.

28. The device of claim 26, wherein the electrodes are arranged on the chamber walls and electrically coupled to apply an electric field signal to cyclically draw the diaphragm towards a first chamber wall and to repel the diaphragm from another chamber wall.

29. The device of claim 26, wherein the diaphragm is configured in a slacked amorphous configuration in its untensioned inactive state.

30. The device of claim 26, wherein the diaphragm is substantially devoid of peaks and valleys in its untensioned inactive state.

* * * * *